US008126180B2

(12) United States Patent
Jacob et al.

(10) Patent No.: US 8,126,180 B2
(45) Date of Patent: Feb. 28, 2012

(54) DUAL CONFIGURATION SPEAKER

(75) Inventors: Kenneth D. Jacob, Framingham, MA (US); Craig R. Jackson, Waltham, MA (US); Joseph J. Kutil, Franklin, MA (US); Peter C. Santoro, Shirley, MA (US); Stuart Raymond Jang, Waltham, MA (US); Michael A. Shramko, South Attleboro, MA (US); John W. Mazejka, Charlton, MA (US); Robert A. Warden, Southborough, MA (US)

(73) Assignee: Bose Corporation, Framingham, MA (US)

( * ) Notice: Subject to any disclaimer, the term of this patent is extended or adjusted under 35 U.S.C. 154(b) by 684 days.

(21) Appl. No.: 12/262,473

(22) Filed: Oct. 31, 2008

(65) Prior Publication Data

US 2010/0111342 A1 May 6, 2010

(51) Int. Cl.
*H04R 9/06* (2006.01)

(52) U.S. Cl. ..... 381/332

(58) Field of Classification Search ..... 381/87–88, 381/332, 334–336

See application file for complete search history.

(56) References Cited

U.S. PATENT DOCUMENTS

| | | | | |
|---|---|---|---|---|
| 4,031,318 | A * | 6/1977 | Pitre | 381/386 |
| 4,042,778 | A | 8/1977 | Clinton | |
| 5,309,518 | A * | 5/1994 | Ickler et al. | 381/336 |
| 5,450,495 | A | 9/1995 | Goldfarb | |
| 5,802,190 | A * | 9/1998 | Ferren | 381/182 |
| 6,394,223 | B1 * | 5/2002 | Lehman | 181/152 |
| 7,016,513 | B2 | 3/2006 | Noselli | |
| 7,319,767 | B2 | 1/2008 | Fidlin et al. | |
| 7,518,055 | B2 | 4/2009 | Zartarian | |
| 2006/0222190 | A1 | 10/2006 | Jacobs et al. | |
| 2007/0017834 | A1 | 1/2007 | Chang et al. | |
| 2008/0267429 | A1 | 10/2008 | Tracy | |

FOREIGN PATENT DOCUMENTS

| | | | |
|---|---|---|---|
| EP | 0593191 | A1 | 4/1994 |
| EP | 1921888 | A1 | 5/2008 |
| WO | 2007/044194 | A1 | 4/2007 |

OTHER PUBLICATIONS

International Search Report and Written Opinion dated Dec. 29, 2009 for PCT/US2009/059674.

Anchor Audio, Inc. Portable Sound Systems, Torrance, California, Brochure for BEACON Portable Array Sound System, 100-0149-000/4-11/06. 4 pages. http://www.anchoraudio/pdf/BEACONmanual.pdf on Nov. 14, 2008.

International Preliminary Report on Patentability dated Jan. 13, 2011 for PCT/US2009/059674.

* cited by examiner

*Primary Examiner* — Tuyen Nguyen

(57) ABSTRACT

A compact and portable loudspeaker system operable in two configurations includes a driver array and a base unit having a bass enclosure and a dock. In an extended configuration, the driver array is supported by one or more extension legs between three to eight feet above the base unit where one of the extension legs is held by the dock. The base unit may be placed on a floor of a small to medium venue with the mid-to-high range driver array elevated near or above the elevation of an audience in the venue. In a compact configuration, the driver array is directly supported by the dock and the base unit and driver array may be placed on a table or desk in a classroom, conference room, or other such small to medium venue. The portable loudspeaker system may be transported in the compact configuration.

21 Claims, 11 Drawing Sheets

DUAL CONFIGURATION SPEAKER

BACKGROUND

This disclosure relates to electro-acoustic transducers housed in enclosures that are commonly referred to as loudspeakers or speakers.

SUMMARY

A compact and portable loudspeaker system operable in two configurations includes a driver array and a base unit having a bass enclosure and a dock. In an extended configuration, the driver array is supported by one or more extension legs between three to eight feet above the base unit where one of the extension legs is held by the dock. The base unit may be placed on a floor of a small to medium venue with the mid-to-high range driver array elevated near or above the elevation of an audience in the venue. In a compact configuration, the driver array is directly supported by the dock and the base unit and driver array may be placed on a table or desk in a classroom, conference room, or other such small to medium venue. The portable loudspeaker system may be transported in the compact configuration.

One embodiment of the present invention is directed to a loudspeaker system comprising: a driver array; and a base unit including a bass enclosure and a dock, the dock adapted to directly support the driver array in a first configuration, the dock adapted to support an extension leg in a second configuration, the extension leg supporting the driver array at an elevation above the base unit. In an aspect, the bass enclosure further comprises a woofer. In an aspect the bass enclosure further comprises a port. In an aspect, the base unit further comprises signal electronics providing an amplified signal to the driver array. In an aspect, the signal electronics further comprises circuitry for equalization of an input signal to the loudspeaker system. In a further aspect, the equalization circuitry includes a digital signal processor. In a further aspect, a set of equalization parameters determining the equalization of the input signal is based at least in part on a source generating the input signal. In an aspect, the signal electronics further comprises circuitry for mixing more than one input signal received by the loudspeaker system. In an aspect, the driver array further comprises a plurality of drivers in a configuration characterized by a spine, each of the drivers characterized by a yaw angle and a pitch angle. In a further aspect, the spine of the driver array is a line. In a further aspect, the spine of the driver array is a simple curve. In a further aspect, the spine of the driver array is a complex curve. In a further aspect, the driver array is an articulated array. In a further aspect, a driver from a first set of drivers characterized by a first yaw angle is interspersed with drivers from a second set of drivers characterized by a second yaw angle that is different from the first yaw angle. In a further aspect, the driver array includes at least six drivers. In an aspect, the base unit includes a handle for single-handed transport of the portable loudspeaker system.

Another embodiment of the present invention is directed to a loudspeaker system comprising: a bass enclosure housing a woofer; a driver array including a plurality of drivers, and signal electronics driving the woofer and driver array, wherein the driver array is attached in front of the bass enclosure in a first configuration and is attached at an elevation above the bass enclosure in a second configuration, the driver array supported by one or more leg extensions in the second configuration, the one or more leg extensions providing mechanical support for the driver array and providing an electrical connection between the driver array and the signal electronics. In one aspect, the driver array is characterized by a spine, wherein the spine is a simple curve. In one aspect, the driver array is an articulated array. In one aspect, the signal electronics further comprises circuitry for equalization of an input signal to the loudspeaker system, the equalization based at least in part on a source generating the input signal.

DETAILED DESCRIPTION

Figure 1:
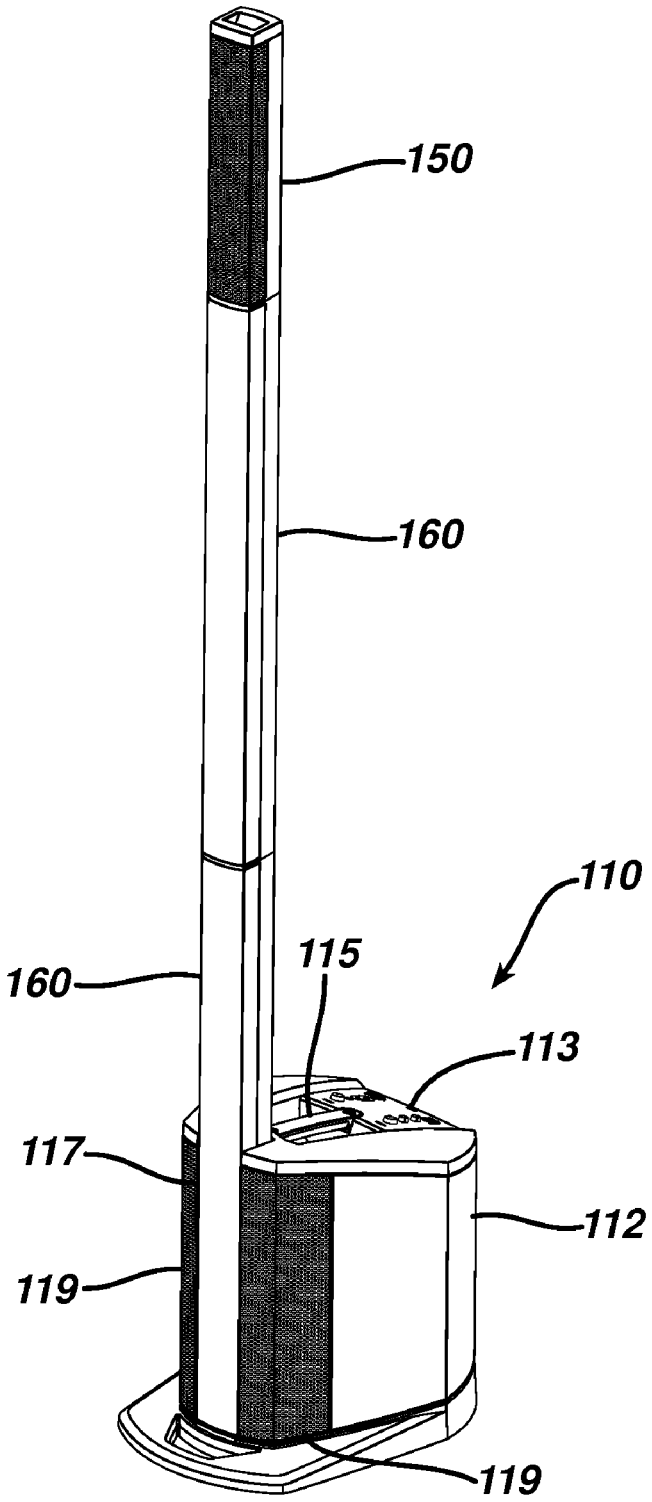
FIG. 1 is a perspective view of a speaker in a first configuration.

FIG. 1 is a perspective view of a compact and portable loudspeaker system in a first configuration. In FIG. 1, the portable loudspeaker system includes a base unit 110 and a driver array 150 supported by one or more extension legs 160. In some embodiments, the extension legs 160 provide an electrical connection between the driver array 150 and the base unit 110. In the extended configuration shown in FIG. 1, the driver array 150 is positioned at an elevation between three to eight feet above the base unit 110 by the extension legs 160.

The base unit 110 includes a bass enclosure 112 and a dock 117. The bass enclosure 112 houses a low-frequency speaker, commonly referred to as a woofer, and signal electronics and controls for the portable loudspeaker system. A control panel 113 provides the user with convenient access to the controls operating the loudspeaker system. The dock 117 provides support for the extension legs 160 in the extended configuration and may also serve as a mechanical guard for the woofer in the bass enclosure 112. In some embodiments, dock 117 may form part of the bass enclosure 112. In some embodiments, dock 117 may be separate from the bass enclosure. Screens 119 extend between the dock 117 and the bass enclosure 112. A handle 115 on the base unit 110 allows for easy, single-handed carrying and transport of the portable system, which preferably weighs less than 30 pounds and more preferably less than 25 pounds. The base unit 110 is preferably compact with a volume of less than three cubic feet and more preferably less than two cubic feet.

In the extended configuration shown in FIG. 1, the base unit 110 may be placed on a floor such that the driver array 150 is positioned at roughly head-height of the audience. The loudspeaker system may provide voice reinforcement for meetings or local sound amplification for solo/small-ensemble musical performances in genres that do not require high sound levels on stage and in the audience. In the extended configuration shown in FIG. 1, extension legs 160 provide a mechanical support for the driver array 150 above the base unit 110 and preferably provide an electrical connection between the driver array and the base unit thereby eliminating the need for a separate array driver stand for the driver array or a separate electrical conductor to connect the driver array to the base unit.

Figure 2:
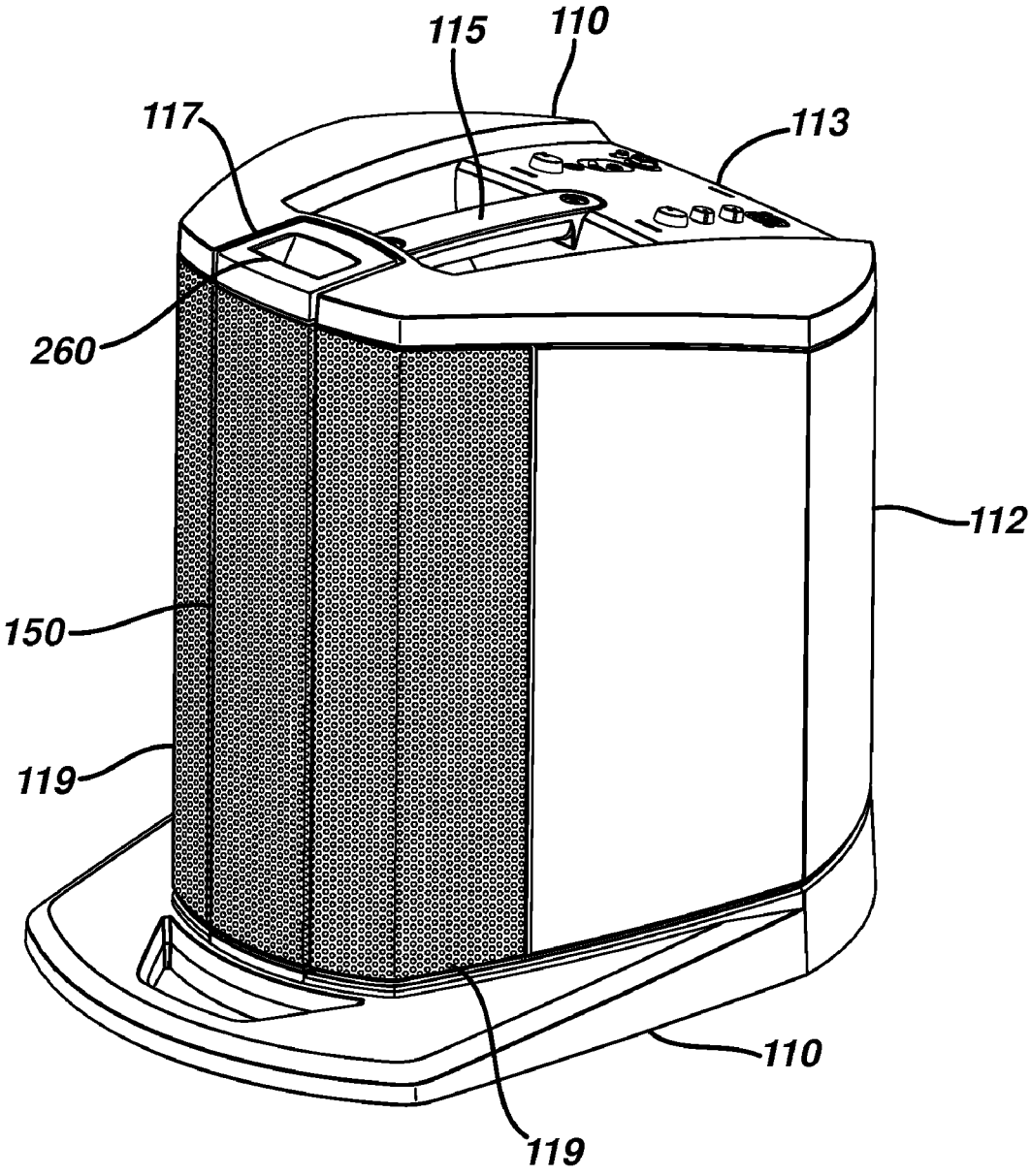
FIG. 2 is a perspective view of a speaker in a second configuration.

FIG. 2 is a perspective view of the compact and portable loudspeaker system shown in FIG. 1 in a second configuration where the same reference numbers refer to the same structure. In the collapsed or compact configuration shown in FIG. 2, the driver array 150 is directly supported and secured in the dock 117. In some embodiments, the driver array 150 is electrically connected to, and driven by, the signal electronics through a connector on the driver array 150. In other embodiments, a separate signal electronics, not shown, may be housed in the driver array 150 and drive the driver array 150. An array handle 260, shown as a recess in FIG. 2, allows a user to grip the driver array 150 and slide the driver array out of the dock 117.

In the collapsed configuration shown in FIG. 2, the base unit 110 may be placed on a table, for example, and used in small settings such as a class room or conference room. The collapsed configuration also allows for convenient transport of both the base unit and the driver array in a compact configuration where the dock provides support for the driver array.

Figure 3:
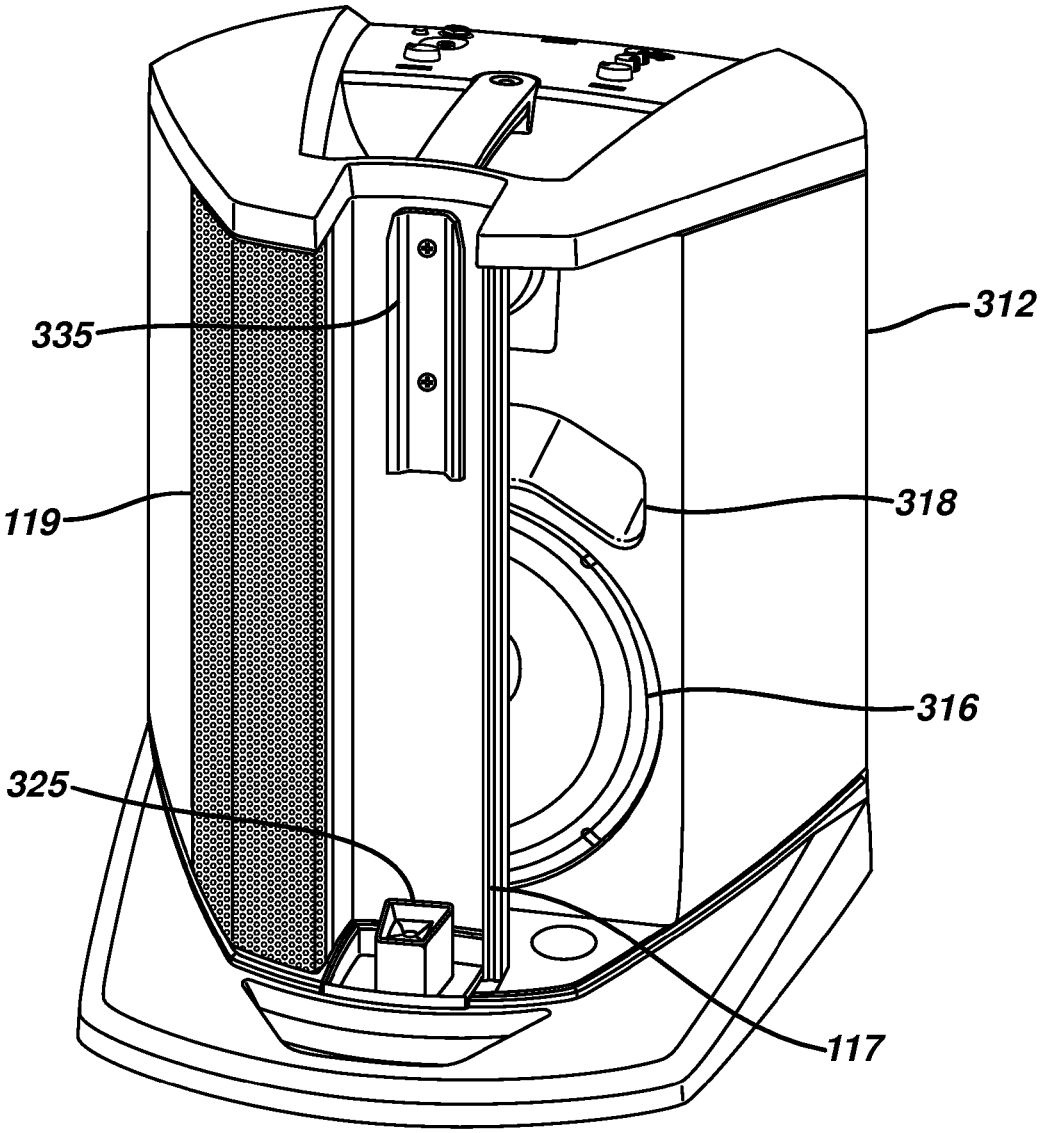
FIG. 3 is perspective view of a base unit.

FIG. 3 is a perspective view of the base unit 110 shown in FIGS. 1 and 2 where the same reference numbers refer to the same structure. The driver array 150 and extension legs 160 are not shown in FIG. 3 in order to show details of the dock 117. Screen 119 extends between one side of the dock 117 and the bass enclosure 112 of the base unit 110 and covers a space between the dock 117 and the bass enclosure 112. The screen 119 is acoustically transparent thereby allowing an acoustic signal generated by a woofer 316 substantially unimpeded travel to a listening volume external to the bass enclosure 112. In FIG. 3, the screen attached to the right side of the dock 117 has been removed to show a side of the bass enclosure 112, normally hidden by screens 119, that supports a woofer 316. An optional acoustic element such as, for example, a port or a passive radiator may be supported by the bass enclosure 112. For example, FIG. 3 shows a port 318.

In the example shown in FIG. 3, the dock 117 includes an electrical connector 325 sized to mate with a complimentary connector on the extension leg 160 or the driver array 150. A guide rail 335 on the dock 117 guides the extension leg 160 or the driver array 150 as the extension leg 160 or the driver array 150 is slid within the dock 117 to mate with the electrical connector 325. The guide rail 335 supports and maintains the extension leg 160 or the driver array 150 in a vertical orientation. In other embodiments, the dock 117 may be oriented in a non-vertical position. It should be understood that dock 117 provides a means for detachably securing the driver array 150 or the extension leg 160 to the base unit 110. Other means for docking the driver array or extension leg that may occur to one of ordinary skill in the art after reading the present description and are understood to be encompassed in the scope of the present subject matter. For example, rails 335 may be replaced by a spring detent opening in the driver array or extension leg and mated with a post/barb configured to fit in the spring detent opening and securely attach the driver array or extension leg to the base unit. In another example, one or more spring-loaded C-clamps may be positioned vertically along the base unit and configured to receive the drive array or extension leg in an open position and to securely fasten the drive array or extension leg in a clamped position.

Figure 4:
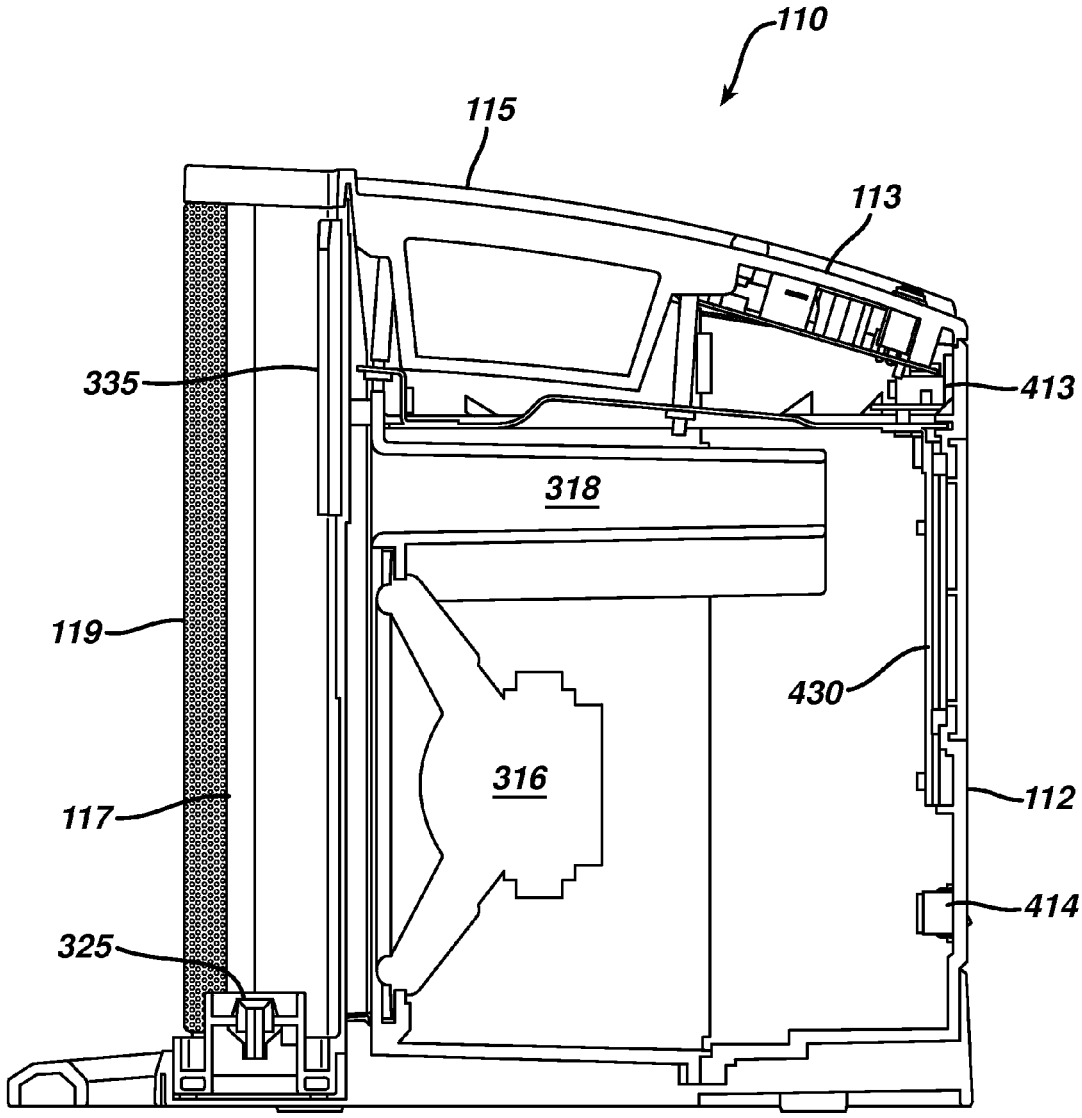
FIG. 4 is a sectional view of a base unit.

FIG. 4 is a sectional view of the base unit shown in FIGS. 1 and 2 where the same reference numbers refer to the same structure. In the example shown in FIG. 4, the bass enclosure 112 supports a woofer 316 and an optional port 318. In the embodiment shown in FIG. 4, signal electronics 430 may be supported on an interior surface of the bass enclosure and drive the woofer 316 and driver array in either the extended or collapsed configuration. In other embodiments, the signal electronics 430 may be housed external to the bass enclosure 112. In other embodiments, separate signal electronics may be house in the driver array to drive the driver array. A power switch 414 may be provided on the bass enclosure. Signal electronics provide an amplified signal to the woofer and the driver array and include a power amplifier and signal filtering circuitry. In some embodiments, signal electronics 430 include circuitry for mixing two or more input signals. In some embodiments, signal electronics 430 include circuitry for equalizing one or more input signals. Signal electronics may be implemented as analog circuitry or as digital circuitry executing instructions from a microprocessor-readable memory or a combination thereof known to a skilled artisan in the electronic arts. In a preferred embodiment, equalization parameters controlling the equalization applied to an input signal is based on the source of the input signal. U.S. Pat. No. 7,319,767 issued Jan. 15, 2008 and U.S. application Ser. No. 11/680,947 filed Mar. 1, 2007, now U.S. Pat. No. 7,518,055, issued Apr. 14, 2009, describe systems and methods for equalizing an input signal based on the source of the input signal and are herein incorporated by reference in their entirety.

Output connectors 413 may be provided to pass through an input signal or a mixed signal to another loudspeaker system or recording device. A control panel 113 enables the user to operate the portable loudspeaker system and connect one or more audio sources to the loudspeaker system for broadcast in a small venue, for example. Examples of an audio source include but are not limited to a microphone, a musical instrument, an audio player, and a computer.

Figure 5:
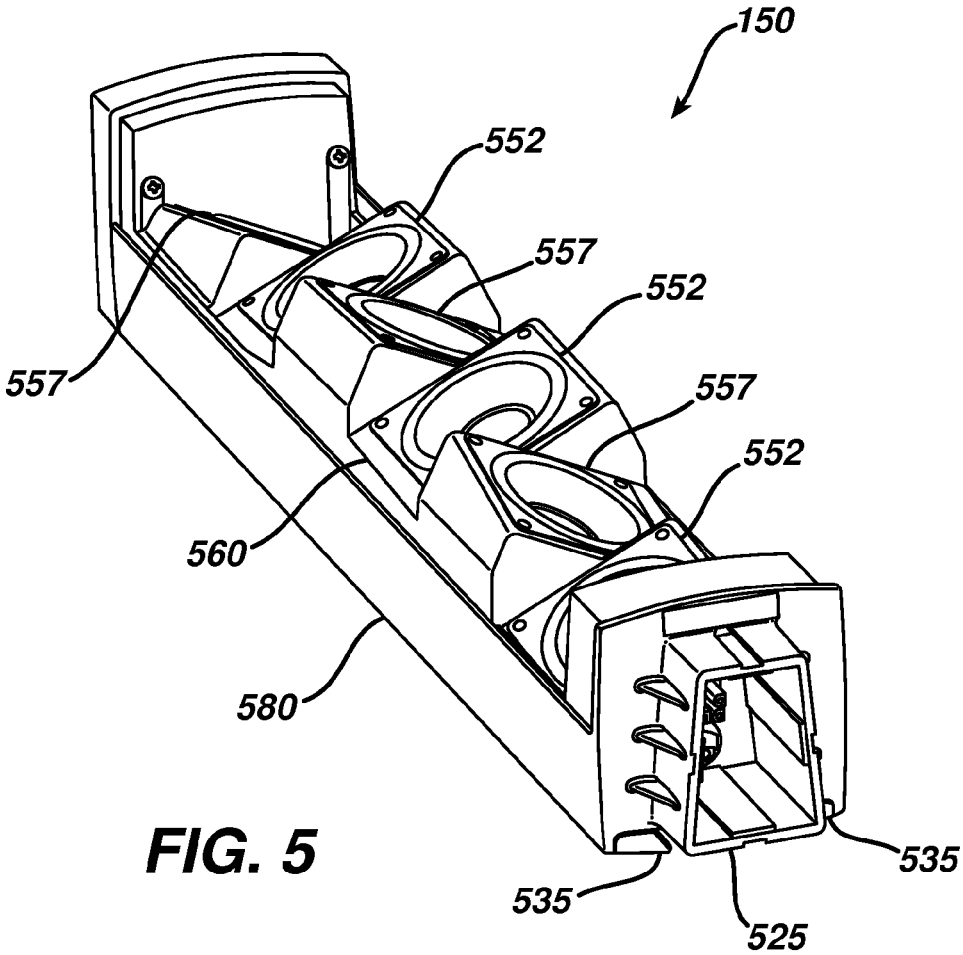
FIG. 5 is a perspective view of a driver array.

FIG. 5 is a perspective view of the driver array of FIGS. 1 and 2 where the same reference numbers refer to the same structure. In FIG. 5, a covering screen has been removed to show details of the driver array. Driver array 150 includes an array support 560 at least partially enclosed by an outer housing 580. In some embodiments, the array support and outer housing may be a single structure. The outer housing 580 includes an array connector 525 positioned at one end on the outer housing 580 and sized and shaped to mate with the electrical connector 325 located on the dock 117 to provide electrical communication between the signal electronics 430 and one or more drivers 552, 557 of the driver array 150. In a preferred embodiment, the shape of the array connector and the electrical connector may be keyed to allow mating of the connectors in a single orientation. The placement of the array connector 525 is not limited to the end of the outer housing and in other embodiments may be located on a side of the outer housing 580. In other embodiments, the connector may be eliminated when, for example, the drive array houses signal electronics to drive the drive array.

One or more rails 535 may be disposed on a rear side of the outer housing 580 and configured to engage with the guide rail 335 on the dock 117. A user may position the driver array 150 at the top of the dock 117 and slide the driver array into the dock. The guide rail and rails align the array connector 525 with the electrical connector 325 and restrict lateral movement of the driver array 150 when the driver array is directly connected to the dock 117.

In the example shown in FIG. 5, the driver array includes six mid-to-high range loudspeakers, commonly referred to as drivers. Other embodiments may include more or less than six drivers. Each driver 552, 557 is oriented and supported by the array support 560.

The orientation of each driver may be described by a position of a reference point and rotations about each principle axis. The reference point and choice of principle axes may be arbitrarily chosen. For example, a first principle axis, herein referred to as the z-axis, may be collinear to the longitudinal axis of the driver's voice coil and represents the direction of the driver's acoustic radiation. A second principle axis, herein referred to as the y-axis, is orthogonal to the z-axis and a rotation about the y-axis is herein referred to as yaw and is characterized by a yaw angle. A third principle axis, herein referred to as the x-axis, is orthogonal to the z-axis and y-axis and a rotation about the x-axis is herein referred to as pitch and is characterized by a pitch angle. The reference point is typically chosen to be the point of intersection of the three principle axes. Using this exemplar coordinate system, various types of driver arrays may be described. For example, a linear array includes one or more drivers configured such that the y-axis of each driver is collinear and defines an array axis. Each driver in the driver array has a zero yaw angle such that each driver points in the same direction. In another example, a J-array includes a first set of drivers configured in a linear array and a second set of drivers where the reference point of each of the second set of drivers lie on a curve in the y-z plane such that the reference points of the first and second sets of drivers form a J-shaped curve. The set of reference points and the curve containing the reference points is herein referred to as the spine of the driver array. The pitch of the second set of drivers may be varied such that the rotated y-axis of each of the second set of drivers is tangent to the spine of the J-array. In another example, an articulated array includes a first set of drivers characterized by a first yaw angle and a second set of drivers characterized by a second yaw angle that is different from the first yaw angle. The first set of drivers may be interspersed with drivers from the second set of drivers. In other examples, the first set of drivers may be segregated from the second set of drivers. The driver array may use any combination of spine curves, yaw angles, and pitch angles.

In the example shown in FIG. 5, array support 560 configures drivers 552, 557 such that the spine of the driver array is curved and the drivers are in an articulated configuration. The spine in FIG. 5 may be a simple curve characterized by a single radius of curvature or may be a complex curve characterized by more than one radii of curvature. It should be understood that an infinite radius of curvature, i.e., a line, may characterize part or the entire spine. The articulated array shown in FIG. 5 illustrates interleaved drivers where drivers 552 from a first set of drivers are interleaved with drivers 557 from a second set of drivers. In some embodiments, the yaw angles of the first and second set of drivers may be selected to provide more horizontal coverage of a venue such that a more consistent tonal balance and level is provided throughout the venue. Drivers in the top half of the array may have a positive pitch angle such that the rotated y-axis of each driver is tangent to the spine. Driver in the bottom half of the array may have a negative pitch angle such that the rotated y-axis of each driver is tangent to the spine. In FIG. 5, the bottom of the array is the point closest to the array connector 525. Other examples of driver arrays that may be used in other embodiments include but are not limited to non-articulated linear arrays, articulated linear arrays, and articulated or non-articulated arrays having spines characterized by complex curves.

Figure 6:
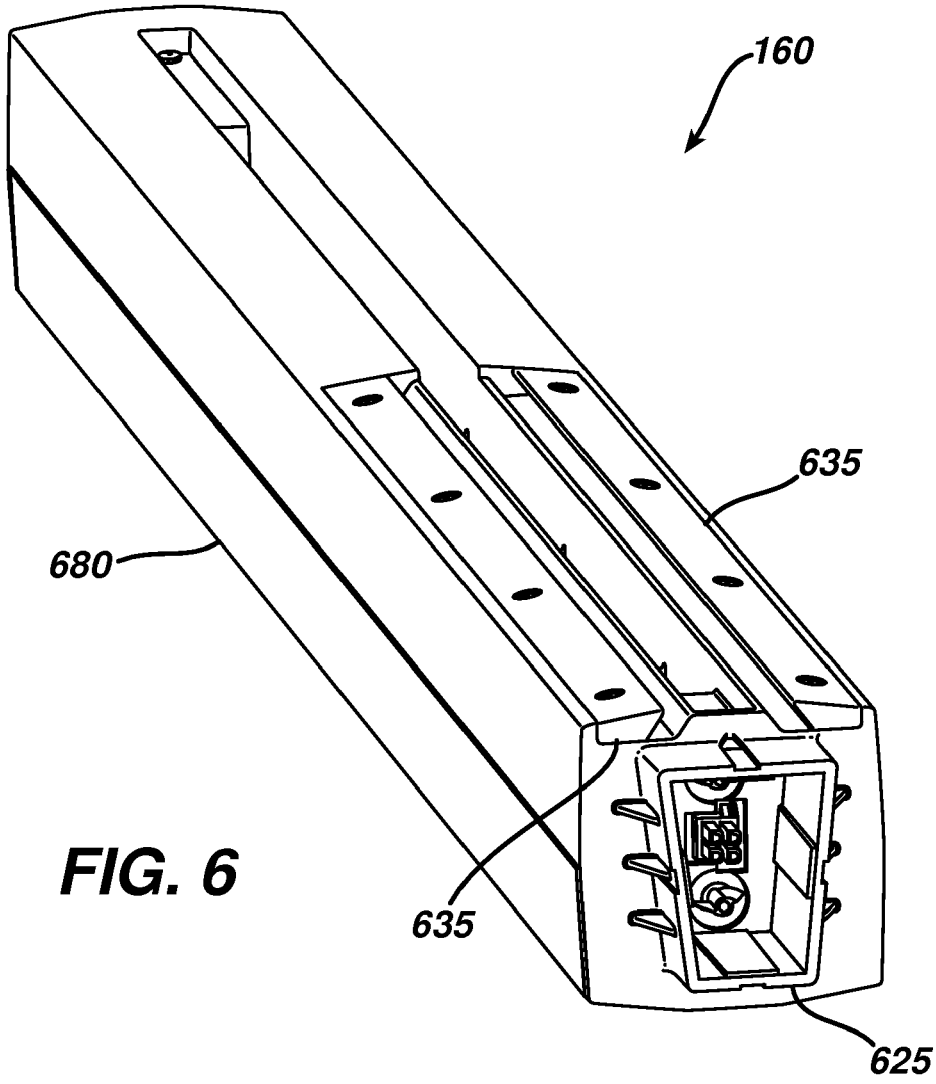
FIG. 6 is a perspective view of an extension assembly.

FIG. 6 is a perspective view of an extension leg where the same reference numbers refer to the same structure. The extension leg 160 includes a leg housing 680 that positions and mechanically supports the driver array 150 in the expanded configuration. A bottom leg connector 625 is positioned at the bottom of the extension leg and is sized and shaped to mate with the electrical connector 325 on the dock 117. An electrical conductor held within the leg extension connects the bottom leg connector 625 to a top leg connector, not shown, position at the top of the leg extension. The top leg connector is sized and shaped to mate with a bottom leg connector on a second leg extension or with the driver array 150.

One or more rails 635 may be disposed on a rear side of the leg housing 680 and configured to engage with the guide rail 335 on the dock 117. A user may position the extension leg 160 at the top of the dock 117 and slide the extension leg into the channel guide. The guide rail and rails align the extension leg 160 with the electrical connector 325 and restrict lateral movement of the extension leg 160. In some embodiments where more than one extension leg is used, each extension leg may include rails 635 such that the user may slide any of the extension legs into the dock 117. In other embodiments, only one extension leg may include rails 635 such that the user can quickly determine which of the extension legs to insert into the channel guide.

Figure 7:
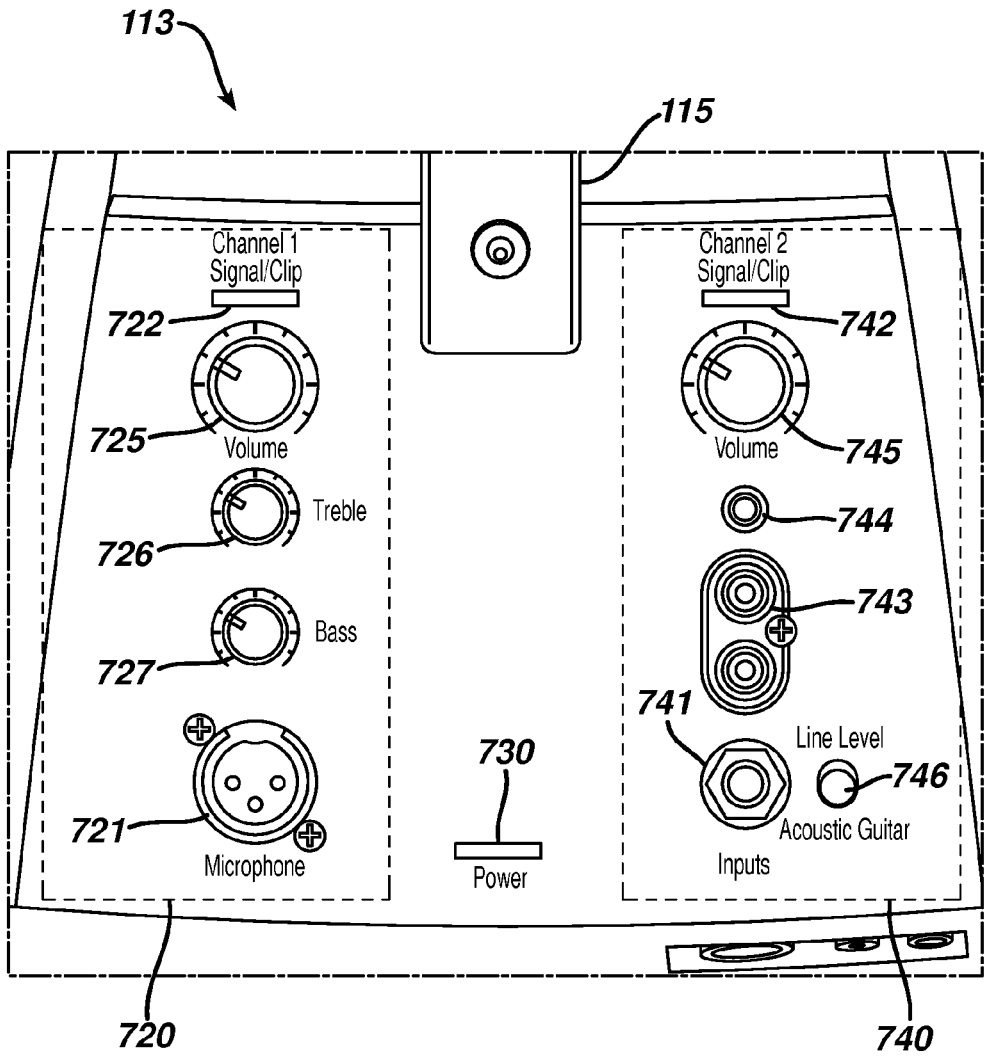
FIG. 7 is a partial top view of an embodiment of a control panel.

FIG. 7 is a partial top view of a control panel shown in FIGS. 1 and 2 where the same reference numbers refer to the same structure. In the example shown in FIG. 7, control panel 113 includes a power indicator 730 and inputs and controls for two input channels 720, 740 although other embodiments may include more than two channels or may include a single input channel. In the example shown in FIG. 7, a first channel 720 includes an XLR microphone connector 721 for connection to a microphone, a bass control 727, a treble control 726, a volume control 725, a clipping indicator 722. An input signal from a microphone connected to the first channel may be equalized according to a pre-determined set of equalization parameters for a generic microphone. Similarly, control parameters such as, for example, gain range and corner frequency for the bass and treble controls may be defined according to a pre-determined set of control parameters for a microphone using the methods described in U.S. application Ser. No. 11/680,947 filed Mar. 1, 2007, now U.S. Pat. No. 7,518,055, issued Apr. 14, 2009, herein incorporated by reference in its entirety.

A second channel includes a volume control 745, a signal clipping indicator 742, and one or more input connectors 741, 743, 744 for receiving signals from a variety of signal sources. Input connector 744 may be a standard ⅛" connector for receiving an input signal from, for example, a computer or digital media player. Input connector 743 may be standard RCA connectors for receiving an input signal from, for example, audio electronics such as for example, stereo amplifiers. Input connector 741 may be a standard ¼" connector for receiving an input signal from musical instruments or equipment such as, for example, electric guitars, keyboards, acoustic instruments equipped with acoustic pickups, microphones, external audio equalizers, and external audio mixers. Equalization switch 746 may provide a pre-determined equalization to the input signal customized for an acoustic guitar when an acoustic guitar is connected to the ¼" connector using the methods described in U.S. application Ser. No. 11/680,947 filed Mar. 1, 2007, now U.S. Pat. No. 7,518, 055, issued Apr. 14, 2009, herein incorporated by reference in its entirety or may provide flat or no equalization to the input signal when, for example, a mixer or equalizer is connected to the ¼" connector.

Figure 8:
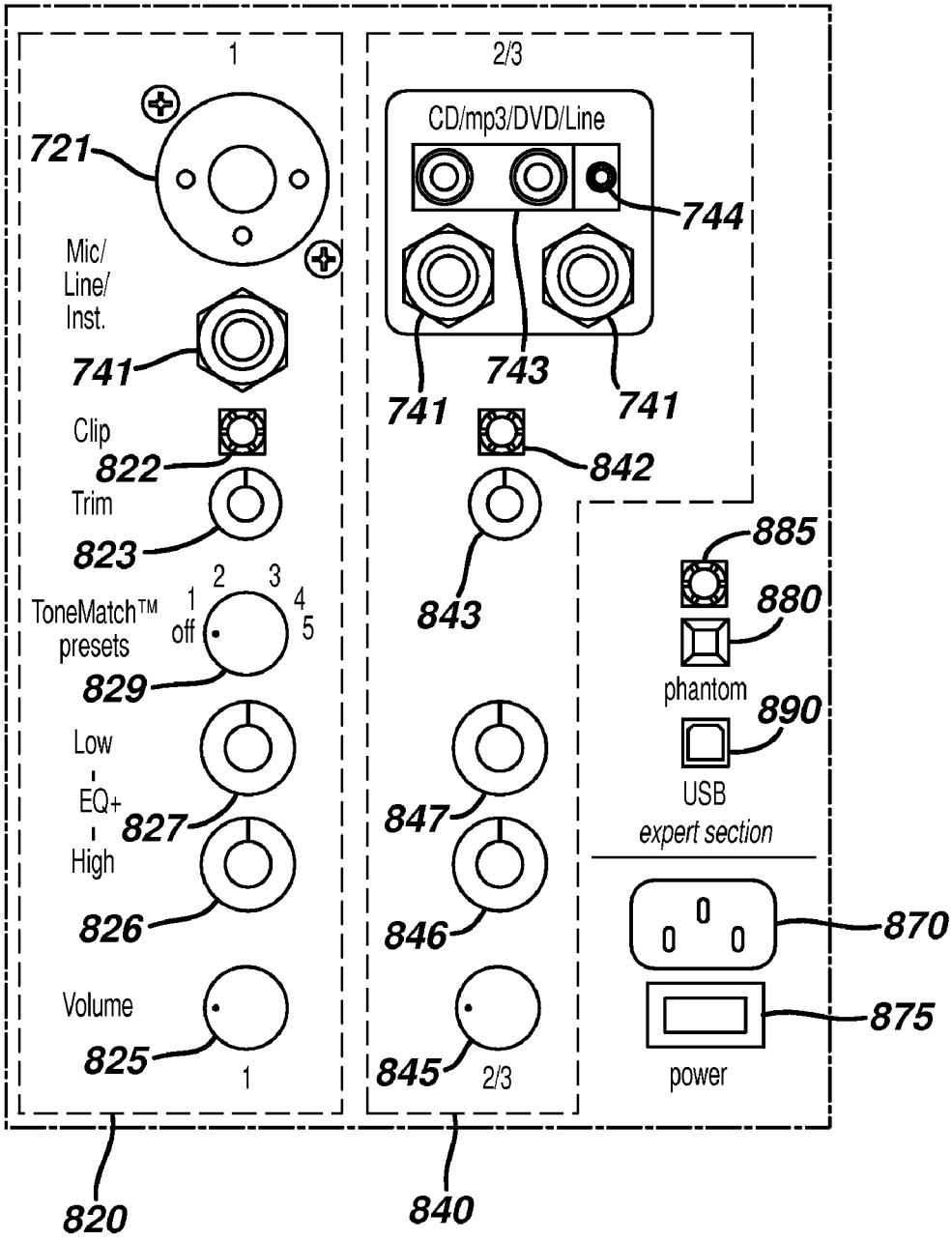
FIG. 8 is a plan view of another embodiment of the control panel.

FIG. 8 is a plan view of another embodiment of a control panel where the same reference numbers refer to the same structure. In the example shown in FIG. 8, a first channel includes an XLR microphone connector 721 for connecting to a microphone, a standard ¼" connector for connecting to musical instruments or audio equipment having a ¼" output male connector, an input signal clipping indicator 822, a channel trim control 823, an equalization selector 829, a low frequency control 827, a high frequency control 826, and a channel volume control 825. The equalization selector 829 allows a user to select a set of predetermined equalization parameters that are applied to the input signal. Each set of predetermined equalization parameters may be associated with a specific type or brand/model of microphone that may be connected to the first channel. In some embodiments, the equalization selector 829 may also select a set of control parameters for the high and low frequency controls 826, 827 based on the specific type or brand/model of microphone that may be connected to the first channel. Examples of control parameters include a gain range for each control and a corner frequency for each control.

A second channel includes a channel volume control 845, a signal clipping indicator 842, a channel trim control 843, a low frequency control 847, a high frequency control 846 and one or more input connectors 741, 743, 744 for receiving signals from a variety of signal sources. Input connectors include a standard ⅛" connector 744, standard RCA connectors 743, and one or more standard ¼" connectors 741. In the example shown in FIG. 8, a standard IEC power connector 870 and power switch 875 are included as part of the control panel. A USB connector 890 is provided as a signal output. A phantom switch 880 and indicator 885 may be provided to allow a user to select a phantom power mode when, for example, a microphone is connected to the first channel.

Figure 9A:
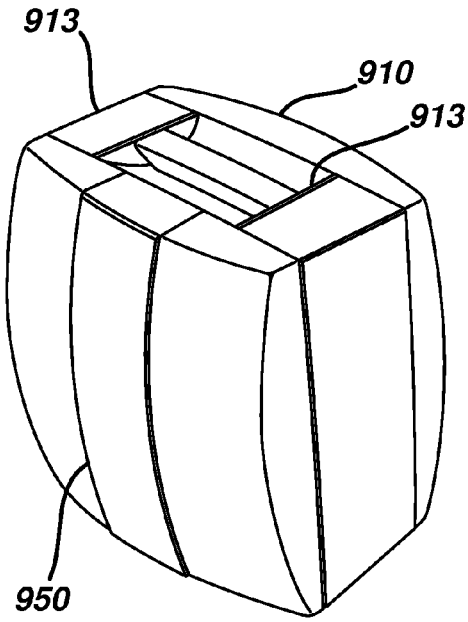
FIG. 9*a* is a perspective view of another embodiment in a first configuration.
Figure 9B:
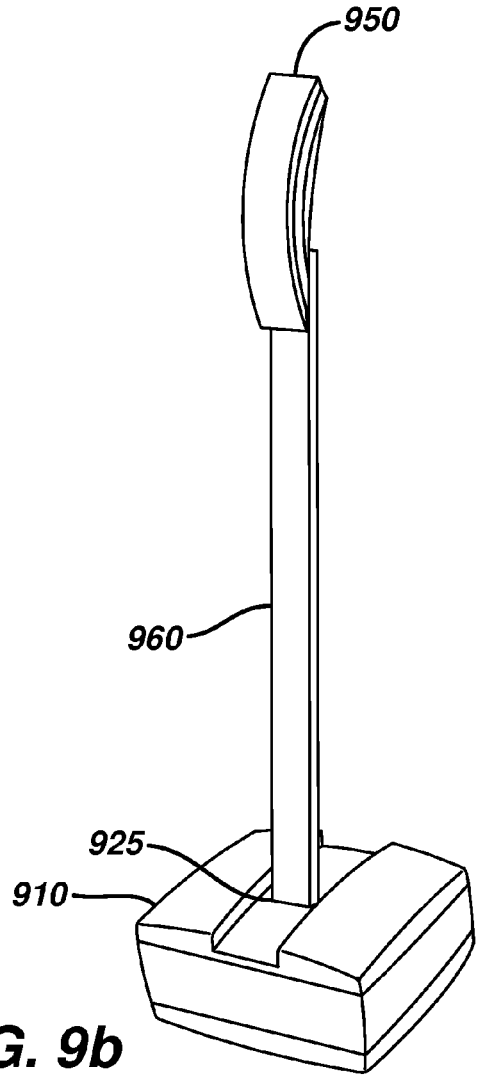
FIG. 9*b* is a perspective view of the embodiment shown in FIG. 9*a* in a second configuration.

FIG. 9*a* is a perspective view of another embodiment in a compact configuration. In FIG. 9*a*, driver array 950 is docked in a base unit 910 that includes a bass enclosure. Speaker controls and connectors may be located on the base unit 910 that are easily or conveniently accessible by the user. For example, the controls and connectors may be placed on a top surface 913 of the base unit 910. FIG. 9*b* is a perspective view of the embodiment shown in FIG. 9*a* in an extended configuration where the same reference numbers refer to the same structure. In the extended configuration, the driver array 950 is supported by a support leg 960. The support leg 960 is connected to the base unit 910 at dock 925.

Figure 10A:
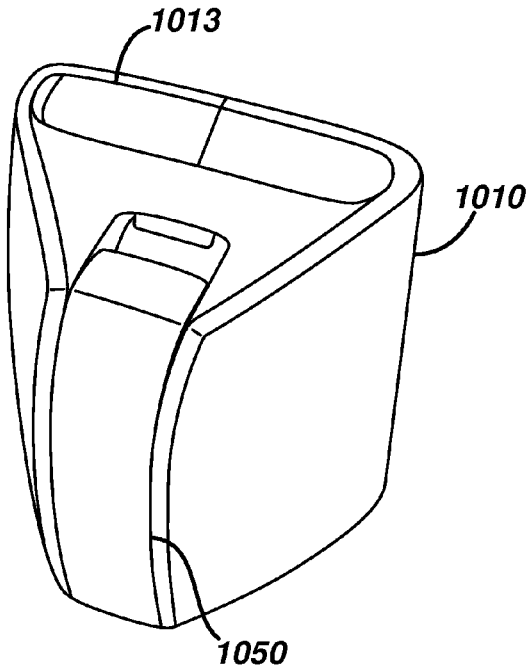
FIG. 10*a* is a perspective view of another embodiment in a first configuration.
Figure 10B:
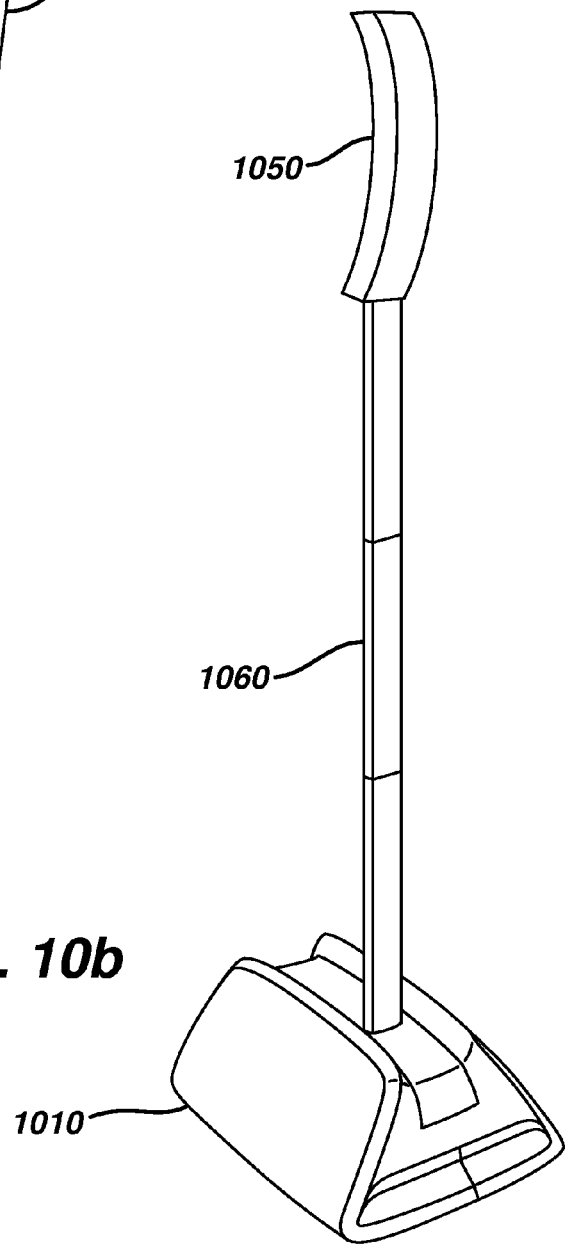
FIG. 10*b* is a perspective view of the embodiment shown in FIG. 10*a* in a second configuration.

FIG. 10*a* is a perspective view of another embodiment in a compact configuration. In FIG. 10*a*, driver array 1050 is docked in a base unit 1010 that includes a bass enclosure. Speaker controls and connectors may be located on the base unit 1010 that are easily or conveniently accessible by the user. For example, the controls and connectors may be placed on a top surface 1013 of the base unit 1010. FIG. 10*b* is a perspective view of the embodiment shown in FIG. 10*a* in an extended configuration where the same reference numbers refer to the same structure. In the extended configuration, the driver array 1050 is supported by a support leg 1060. The support leg 1060 is removeably attached to the base unit 1010. Support leg 1060 may be a one-piece leg that can fold into a more compact shape for transport or may be a telescoping one-piece leg.

Figure 11A:
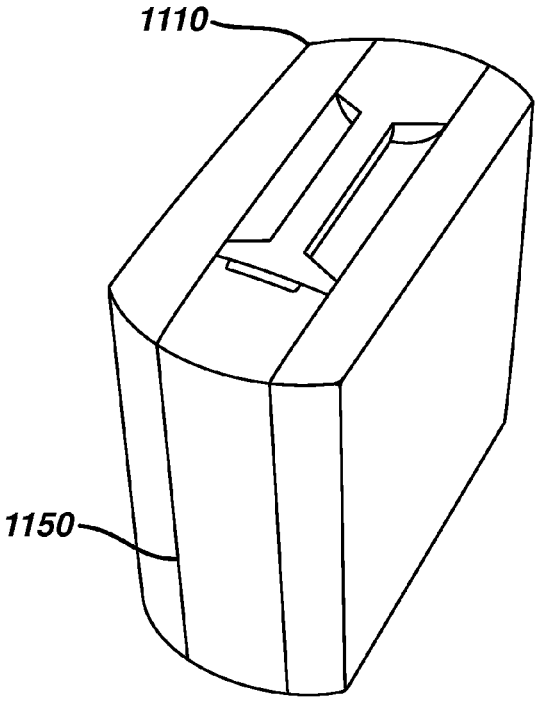
FIG. 11*a* is a perspective view of another embodiment in a first configuration.
Figure 11B:
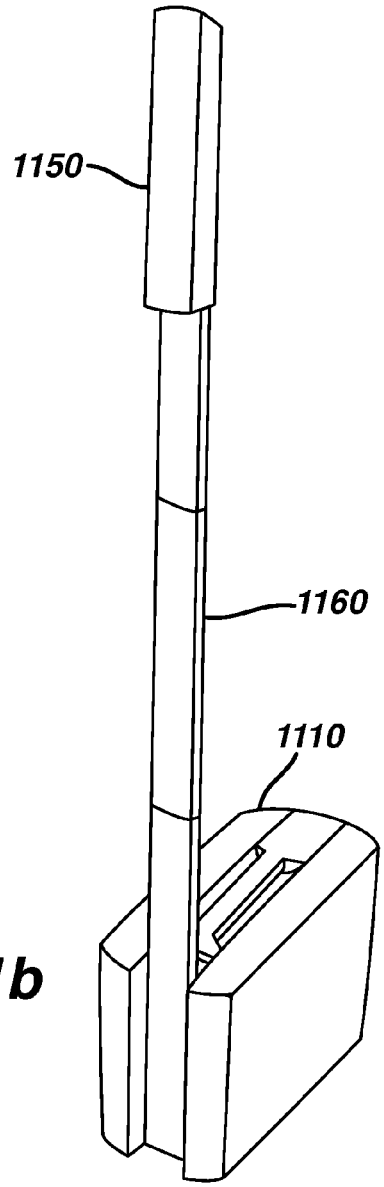
FIG. 11*b* is a perspective view of the embodiment shown in FIG. 11*a* in a second configuration.

FIG. 11*a* is a perspective view of another embodiment in a compact configuration. In FIG. 11*a*, driver array 1150 is docked in a base unit 1110 that includes a bass enclosure. Speaker controls and connectors may be located on the base unit 1010 that are easily or conveniently accessible by the user. FIG. 11*b* is a perspective view of the embodiment shown in FIG. 11*a* in an extended configuration where the same reference numbers refer to the same structure. In the extended configuration, the driver array 1150 is supported by a support leg 1160. The support leg 1160 is removeably attached to the base unit 1110. Support leg 1160 may be a one-piece leg that can fold into a more compact shape for transport or may be a telescoping one-piece leg.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the present invention.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed:

1. A loudspeaker system comprising:

a driver array; and a base unit including a bass enclosure and a dock, the dock adapted to directly support the driver array in a recess in the base unit, external to the bass enclosure, in a first configuration, the dock adapted to support an extension leg in the recess in a second configuration, the extension leg supporting the driver array at an elevation above the base unit, wherein the driver array is operable to output acoustic energy in both the first and the second configuration.

2. The loudspeaker system of claim 1 wherein the bass enclosure further comprises a woofer.

3. The loudspeaker system of claim 1 wherein the bass enclosure further comprises a port.

4. The loudspeaker system of claim 1 wherein the base unit further comprises signal electronics providing an amplified signal to the driver array.

5. The loudspeaker system of claim 4 wherein the signal electronics further comprises circuitry for equalization of an input signal to the loudspeaker system.

6. The loudspeaker system of claim 5 wherein the equalization circuitry includes a digital signal processor.

7. The loudspeaker system of claim 5 wherein a set of equalization parameters determining the equalization of the input signal is based at least in part on a source generating the input signal.

8. The loudspeaker system of claim 4 wherein the signal electronics further comprises circuitry for mixing more than one input signal received by the loudspeaker system.

9. The loudspeaker system of claim 1 wherein the driver array further comprises a plurality of drivers in a configuration characterized by a spine, each of the drivers characterized by a yaw angle and a pitch angle.

10. The loudspeaker system of claim 9 wherein the spine of the driver array is a line.

11. The loudspeaker system of claim 9 wherein the spine of the driver array is a simple curve.

12. The loudspeaker system of claim 9 wherein the spine of the driver array is a complex curve.

13. The loudspeaker system of claim 9 wherein the driver array is an articulated array.

14. The loudspeaker system of claim 13 wherein a driver from a first set of drivers characterized by a first yaw angle is interspersed with drivers from a second set of drivers characterized by a second yaw angle that is different from the first yaw angle.

15. The loudspeaker system of claim 9 wherein the driver array includes at least six drivers.

16. The loudspeaker system of claim 1 wherein the base unit includes a handle for single-handed transport of the portable loudspeaker system.

17. A loudspeaker system comprising:

a bass enclosure housing a woofer;

a driver array including a plurality of drivers, and signal electronics driving the woofer and driver array, wherein the driver array is attached in a recess in front of and external to the bass enclosure in a first configuration and is attached at an elevation above the bass enclosure in a second configuration, the driver array supported by one or more leg extensions in the second configuration, the one or more leg extensions attached in the recess and providing mechanical support for the driver array and providing an electrical connection between the driver array and the signal electronics.

18. The loudspeaker system of claim 17 wherein the driver array is characterized by a spine, wherein the spine is a simple curve.

19. The loudspeaker system of claim 17 wherein the driver array is an articulated array.

20. The loudspeaker system of claim 17 wherein the signal electronics further comprises circuitry for equalization of an input signal to the loudspeaker system, the equalization based at least in part on a source generating the input signal.

21. The loudspeaker system of claim 1 wherein the dock includes a first electrical connector adapted to provide signals to the driver array;

the driver array includes a second electrical connector adapted to couple to the first electrical connector; and the extension leg includes a third electrical connector adapted to couple to the first electrical connector and a fourth electrical connector adapted to couple to the second electrical connector.

* * * * *